US005878453A

United States Patent [19]

Stokes

[11] Patent Number: 5,878,453

[45] Date of Patent: Mar. 9, 1999

[54] LEG SUPPORT PILLOW

[76] Inventor: Lowell Stokes, 440 Country La., Louisville, Ky. 40207

[21] Appl. No.: 985,506

[22] Filed: Dec. 5, 1997

[51] Int. Cl.[6] ..... A47C 16/02; A47C 20/00

[52] U.S. Cl. ..... 5/648; 5/630

[58] Field of Search ..... 5/630, 632, 648, 5/649, 650, 651; 128/882

[56] References Cited

U.S. PATENT DOCUMENTS

| | | | |
|---|---|---|---|
| D. 308,787 | 6/1990 | Youngblood . | |
| D. 318,392 | 7/1991 | Edelson . | |
| D. 342,856 | 1/1994 | Hagen . | |
| D. 345,668 | 4/1994 | Braly . | |
| D. 348,175 | 6/1994 | Kilbey . | |
| 2,952,856 | 9/1960 | Ruff | 5/640 |
| 4,177,806 | 12/1979 | Griffin . | |
| 4,736,477 | 4/1988 | Moore . | |
| 4,910,818 | 3/1990 | Grabill et al. . | |
| 4,956,886 | 9/1990 | Sarkozi | 5/640 |
| 5,117,522 | 6/1992 | Everett . | |
| 5,125,123 | 6/1992 | Engle . | |
| 5,418,991 | 5/1995 | Shiflett . | |
| 5,573,014 | 11/1996 | Ginter . | |
| 5,664,271 | 9/1997 | Bellavance | 5/648 |
| 5,746,218 | 5/1998 | Edge | 5/648 |

*Primary Examiner*—Michael F. Trettel
*Attorney, Agent, or Firm*—Wheat, Camoriano, Smith & Beres PLC

[57] ABSTRACT

A pillow for alleviating lower back pain includes an under-knee portion, which holds an individual's knee in flexion when he is lying on his back, and a between-knee portion, which holds the individual's knees a spaced distance apart when he is lying on his side. The under-knee and between-knee portions are connected by a flexible web that permits automatic adjustment of the relative positions of the two pillow portions to accommodate different sizes of users.

9 Claims, 3 Drawing Sheets

LEG SUPPORT PILLOW

BACKGROUND OF THE INVENTION

The present invention relates to pillows constructed to alleviate lower back pain. There have been many different pillows and cushions that have been designed to alleviate lower back pain. Many of these pillows serve to hold an individual's legs in a flexed position when the individual is lying on his back (supine position). Other pillows hold an individual's knees apart while he is lying on his side (lateral decubitus position). A conventional pillow may be used below the knees to maintain flexion or between the knees to maintain spacing, but the pillow must be re-positioned whenever an individual rolls from his back onto his side, or vice versa. Moreover, a conventional pillow is easily displaced as an individual moves and turns while he is sleeping. Thus, it would be desirable to have a dual-function pillow that provides the necessary support regardless of whether the individual is lying on his back or on his side and that does not have to be re-positioned when the individual moves.

There have been a few attempts in the prior art to construct such a dual-function pillow. For example, U.S. Pat. No. 4,910,818, issued to Grabill et al., describes a dual-function pillow that includes three lobes, two of which form a base that is positioned below an individual's knees, and a third lobe which extends from the base between the individual's knees. This device provides support below the knees when an individual is in a supine position, and between the knees when the individual is lying on his side. The construction of this pillow, however, does not allow for adjustment of the position of the center lobe relative to the base lobes. The position of the center lobe is fixed relative to the base lobes. Thus, if the width of the pillow is not precisely tailored to the individual, the center lobe will not be at the correct height when the individual is lying on his side. The width of the pillow should be at least the width of a user's hips to prevent the user's legs from slipping off. However, if the pillow is made wide enough for a majority of users, a user with narrower hips has difficulty using the pillow while lying on his side because the center lobe of the pillow will cause his upper leg to be held up in the air. As for users with wider hips, the fixed center lobe prevents the pillow from resting on the bed while the user is lying on his side, resulting in the user supporting the full weight of the pillow. These difficulties prevent a single pillow from accommodating different sizes of people. This pillow must be custom fit to the user. In short, the prior art design, with the center lobe fixed relative to the base lobes, has several disadvantages that make the pillow impractical for common usage.

SUMMARY OF THE INVENTION

The present invention is a dual-function pillow that includes an under-knee portion that holds an individual's knees in a flexed position when he is lying on his back and a between-knee portion that holds an individual's knees a spaced distance apart when he is lying on his side. The two portions of the pillow are connected by a flexible web that allows for the shifting of the relative positions of the two portions. Because of this adjustability, the under-knee portion can be made amply wide so that the user's legs do not slip off the pillow without creating problems when the user rolls to his side.

DESCRIPTION OF THE PREFERRED EMBODIMENTS

Figure 1:
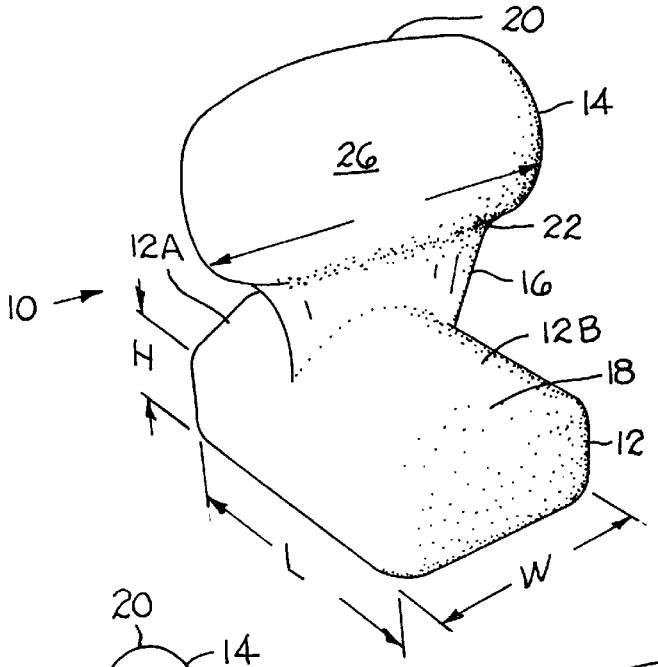
FIG. 1 is a perspective view of a leg support pillow in accordance with the present invention.

FIGS. 1–5 show a preferred embodiment of a leg support pillow 10 made in accordance with the present invention. The leg support pillow 10 includes an under-knee portion 12, a between-knee portion 14, and a flexible web 16 that connects the under-knee portion 12 to the between-knee portion 14. For the purposes of this description, a web is a flexible material that joins two members together. Each portion 12, 14 is preferably constructed of a foam material that is contained in a fabric cover. The foam material must have sufficient rigidity to provide the necessary support, but it should also be comfortable for the user. As an alternative, the two portions 12, 14 could be constructed of an inflatable plastic, with air pressure or some other gas pressure providing the necessary support. Other pillow materials are also known and could be used in the present invention.

The leg support pillow 10 of FIGS. 1–5 might alternatively be described as having three lobes, as indicated in FIG. 1. The first and third lobes 12A, 12B are connected together in a coaxial, end-to-end relationship to form the under-knee portion 12. The second lobe 14 extends substantially perpendicular to the first and third lobes 12A, 12B, and is otherwise referred to as the between-knee portion 14. The flexible web 16 extends from the junction of the first and third lobes 12A, 12B to the second lobe 14, thereby connecting the first and third lobes 12A, 12B to the second lobe 14.

Figure 3:
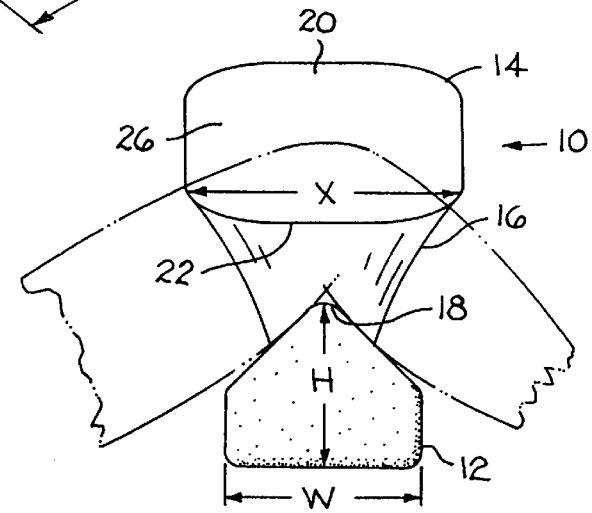
FIG. 3 is a side view of the leg support pillow of FIG. 1 with a user's legs indicated in phantom.

The under-knee portion 12 defines a length L, a width W, and a height H. The length L is substantially perpendicular to the web 16, and the width W is in the direction of the web 16, with the length L being substantially greater than the width W. The length L and the width W define a substantially rectangular base. The height H, however, varies along the width W of the under-knee portion 12. As best shown in FIG. 3, the height H is at a maximum at the midpoint of the width W. Thus, the under-knee portion 12 has a rounded peak 18 that extends along its entire length L. As will be further explained, this rounded peak 18 holds the user's knees in flexion when the user is in a supine position.

Figure 2:
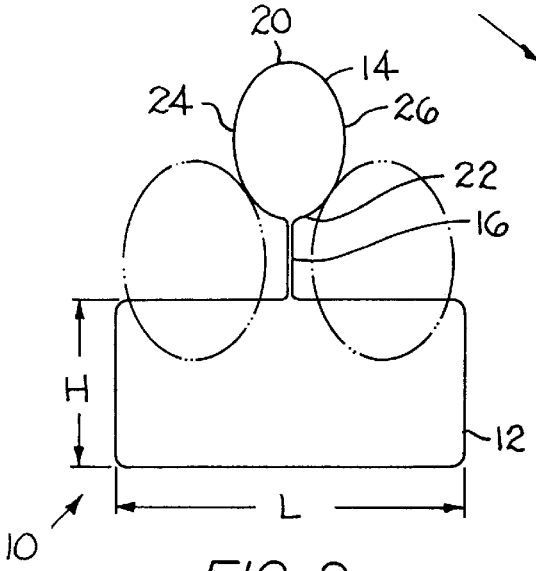
FIG. 2 is a front view of the leg support pillow of FIG. 1 with a user's legs indicated in phantom.

The between-knee portion 14 has a top side 20, a bottom side 22, a left side 24, and a right side 26. The left-to-right dimension of the between-Knee portion 14, running substantially perpendicular to the web 16, is substantially less than the dimension in the direction of the web 16, and it is substantially less than the length L of the under-Knee portion 12 perpendicular to the web. As best shown in FIG. 2, the between-knee portion 14 preferably has an oblong cross-section with the left and right sides 24, 26 constituting a large portion of the overall surface area of the between-knee portion 14. As will be further explained, when a user is lying on his side, his knees rest against the left and right sides 24, 26 of the between-knee portion with the thickness of this portion 14 determining the spacing between the knees.

The flexible web 16 connects the under-knee portion 12 to the between-knee portion 14. The web 16 is not a rigid member. It is flexible and allows the two portions 12, 14 to move relative to one another. Although the under-knee and between-knee portions 12, 14 of the pillow 10 are somewhat flexible, the web 16 is much more flexible than either portion 12, 14. The web preferably also has a thickness substantially less than the thickness of the pillow portions 12, 14. The web 16 is preferably constructed of a fabric, and may be constructed of the same material as the fabric cover of the under-knee and between-knee portions 12, 14. The web 16 is preferably sewn or similarly attached to the under-knee portion 12 at the center of its length L, and to the between-knee portion 14 along its bottom side 22. As a further refinement, the web 16 preferably extends substantially along the entire length X of the between-knee portion 14 and along a substantial portion of the width W of the under-knee portion 12 to limit the possibility of twisting of the between-knee portion 14 relative to the under-knee portion 12.

Figure 4:
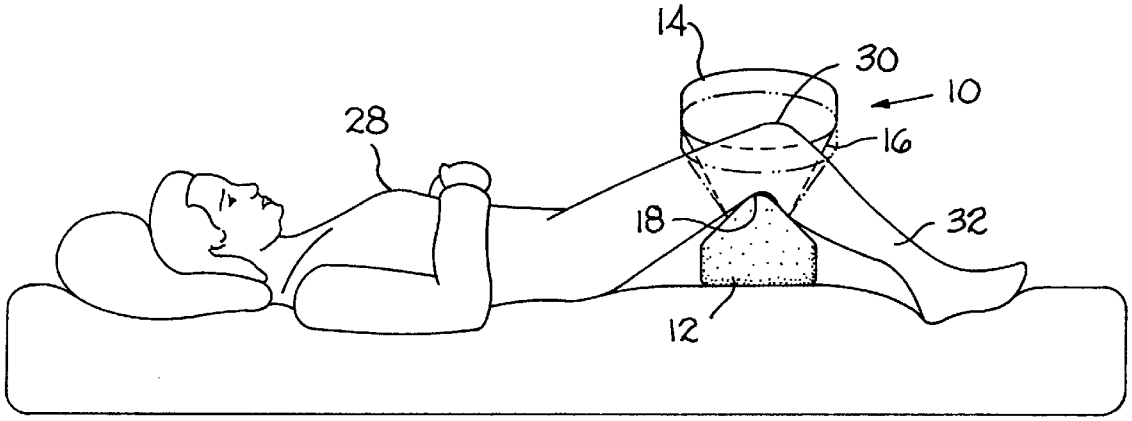
FIG. 4 is a side view of an individual lying on his back using the leg support pillow of FIG. 1.

Referring now to FIG. 4, when a user 28 is lying on his back, the leg support pillow 10 is positioned such that the under-knee portion 12 is situated below the user's knees 30 with the between-knee portion 14 extending upwardly between the user's knees 30. The user 28 rests his legs 32 over the under-knee portion 12, and the rounded peak 18 of the under-knee portion 12 creates a fulcrum over which the legs 32 are bent. Thus, flexion is maintained in the knees 30 and the back is flat while the user 28 is in a supine position.

Figure 5:
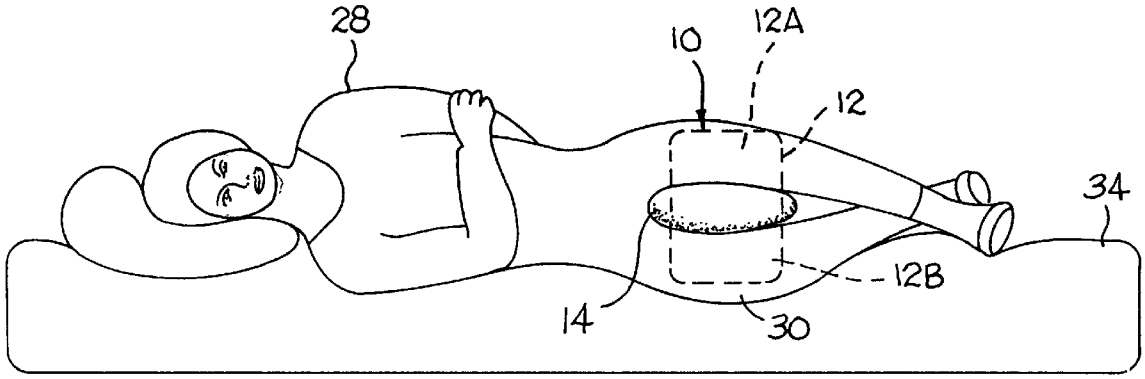
FIG. 5 is a side view of an individual lying on his side using the leg support pillow of FIG. 1.

In FIG. 5, the user 28 is lying on his side. The between-knee portion 14 of the leg support pillow 10 remains in place between the user's knees 30. The between-knee portion 14 now serves to maintain a predetermined spacing between the user's knees 30. The under-knee portion 12 is situated behind the user 28 with the flexible web 16 permitting the under-knee portion 14 to rest against the bed 34 so that the weight of the under-knee portion 12 is supported by the bed 34, and not by the user 28.

The leg support pillow 10 of the present invention thus provides the necessary support for alleviating lower back pain whether an individual is lying on his back or on his side. As described, the flexible web 16 that connects the under-knee portion 12 to the between-knee portion 14 is particularly important in that it permits the two portions 12, 14 to shift relative to one another. The web 16 permits the between-knee portion 14 to move independently, that is, when an individual is lying on his side, the between-knee portion 14 will remain between the user's knees and will not be restricted to a predetermined height based on the size of the under-knee portion 12. Because of this adjustability, it is not required that the leg support pillow 10 be of a certain size to ensure that the between-knee portion 14 is at the proper height when a user is lying on his side. The leg support pillow 10 therefore accommodates different sizes of people and need not be custom fit to the user.

Figure 6:
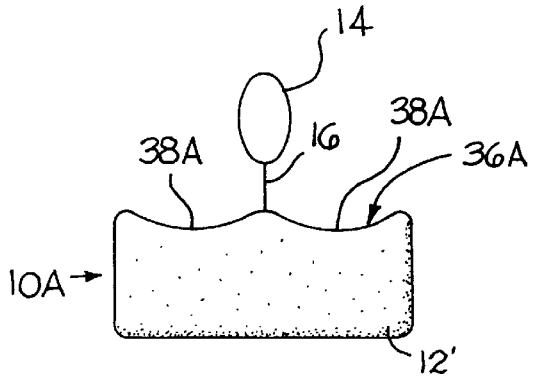
FIG. 6 is a front view of a first alternative embodiment of a leg support pillow in accordance with the present invention.
Figure 7:
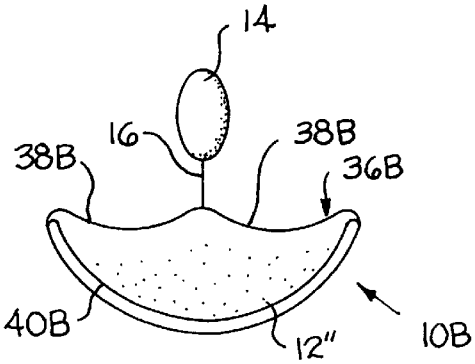
FIG. 7 is a front view of a second alternative embodiment of a leg support pillow in accordance with the present invention.
Figure 8:
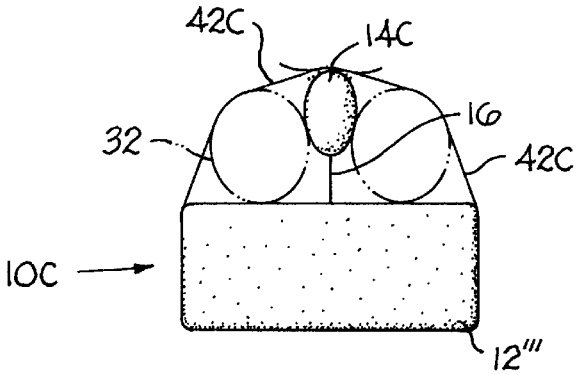
FIG. 8 is a front view of a third alternative embodiment of a leg support pillow in accordance with the present invention with a user's legs indicated in phantom.

FIGS. 6–8 demonstrate modifications that may be made to the basic structure of the leg support pillow 10. FIG. 6 shows a first alternative embodiment of the leg support pillow 10A, wherein the top surface 36A of the under-knee portion 12' defines two indentations 38A for receiving the user's legs. FIG. 7 shows a second alternative embodiment of the pillow 10B, wherein the top surface 36B of the under-knee portion 12" defines two indentations 38B for receiving the user's legs, and the bottom surface 40B of the under-knee portion 12" is curved to facilitate rolling from side to side. FIG. 8 shows a third alternative embodiment of the pillow 10C, wherein straps 42C extend from the ends of the under-knee portion 12'" to the top of the between-knee portion 14C. The user's legs 32 are inserted between the straps 42C and the pillow portions 12'", 14 to aid in retaining the pillow 10C on the user's legs 32 while the user moves about during sleep.

FIGS. 9–12 show a fourth alternative embodiment of a pillow made in accordance with the present invention. This pillow 110 includes an under-knee portion 112, and left and right between knee portions 114A, 114B, which are connected to the under-knee portion 112 by webs 116. The between knee portions 114A, 114B include a raised portion 140 in their top surface, near the edge that connects to the web 116, the function of which will be described later.

Figure 9:
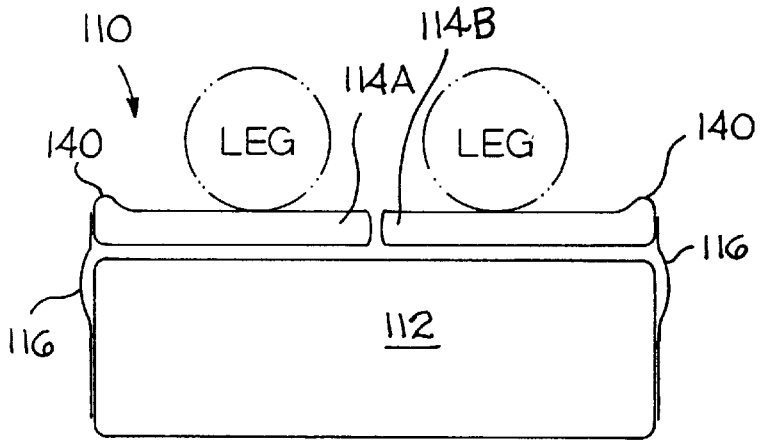
FIG. 9 is a front view of a fourth alternative embodiment of a leg support pillow in accordance with the present invention.
Figure 10:
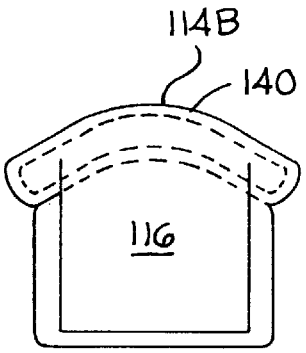
FIG. 10 is a side view of the pillow of FIG. 9.

When a person is lying on his back, or is supine, as shown in FIG. 9, the left and right between-knee portions 114A, 114B are lying on top of the under-knee portion 112, and the person's legs are resting on top of the between-knee portions 114A, 114B, which, in turn, are resting on top of the under-knee portion 112.

Figure 11:
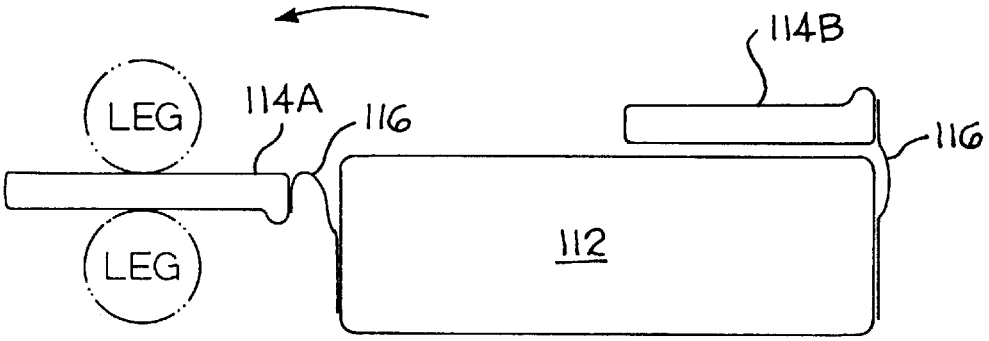
FIG. 11 is a front view of the pillow of FIG. 9, with the person rolling to the left side.

When the person rolls to the left, as shown in FIG. 11, his left leg contacts the left raised portion 140 as he is rolling over, which causes the left between-knee pillow 114A to unfold and move to the left, so it lies between the person's legs as he lies on his left side.

Figure 12:
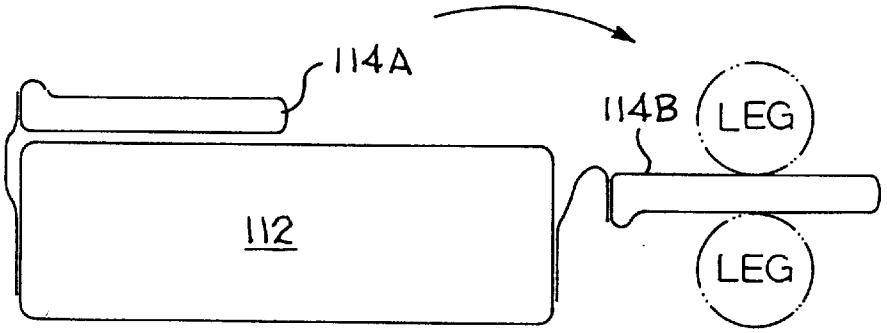
FIG. 12 is a front view of the pillow of FIG. 9, with the person rolling to the right side.

Similarly, when the person rolls to the right, as shown in FIG. 12, the right leg is contacts the raised portion 140 on the right between-knee portion 114B, causing it to unfold to the right, so it lies between the person's legs when he is on his right side.

It will be obvious to those skilled in the art that modifications may be made to the embodiments described above without departing from the scope of the present invention.

What is claimed is:

1. A pillow, comprising:

an under-knee pillow portion, defining a width, length, and height;

a between-knee pillow portion, defining a top, bottom, and left and right sides; and a flexible web connecting said between-knee portion to said under-knee portion, wherein said flexible web is connected to said under-knee portion at approximately the center of the length of the under-knee portion, and wherein the length of the under-knee pillow portion lying substantially perpendicular to the web is substantially greater than the left-to-right dimension of the between-knee pillow portion lying substantially perpendicular to the web, so that a user can lie on his back, with the under-knee portion under his knees, and can roll to his side, with the between-knee portion between his knees and the under-knee portion resting behind him, with the flexible web permitting automatic adjustment of the relative positions of the pillow portions to accommodate different sizes of users.

2. A pillow, as recited in claim 1, wherein said flexible web is connected to said between-knee portion at the bottom of the between-knee portion.

3. A pillow, as recited in claim 1, wherein said under-knee portion has a curved bottom surface to facilitate the user's rolling over from side to side.

4. A pillow, as recited in claim 1, wherein said between-knee portion has a length, and wherein said web extends substantially along the entire length of said between-knee portion to limit the opportunity for twisting of said between-knee portion relative to said under-knee portion.

5. A pillow, comprising:

an under-knee pillow portion, defining a width, length, and height; wherein said under-knee portion has a top surface and defines two indentations in said top surface for receiving the user's two legs, a between-knee pillow portion, defining a top, bottom, and left and right sides; and a flexible web connecting said between-knee portion to said under-knee portion, so that a user can lie on his back, with the under-knee portion under his knees, and can roll to his side, with the between-knee portion between his knees and the under-knee portion resting behind him, with the flexible web permitting automatic adjustment of the relative positions of the pillow portions to accommodate different sizes of users.

6. A pillow, comprising:

an under-knee pillow portion, defining a width, length, and height;

a between-knee pillow portion, defining a top, bottom, and left and right sides; and a flexible web connecting said between-knee portion to said under-knee portion, and further comprising straps extending from said under-knee portion to the top of said between-knee portion to help retain the pillow on the user while the user moves about during sleep, so that a user can lie on his back, with the under-knee portion under his knees, and can roll to his side, with the between-knee portion between his knees and the under-knee portion resting behind him, with the flexible web permitting automatic adjustment of the relative positions of the pillow portions to accommodate different sizes of users.

7. A pillow, for use in supporting a user's knees when reclining, comprising:

first, second, and third lobes; said first and third lobes connected together in coaxial, end-to-end relationship, so they can lie beneath the knees of a user, and said second lobe extending substantially perpendicularly to said first and third lobes where the ends of the first and third lobes meet, so that, when the first and third lobes are beneath the knees of a user, the second lobe can be between the knees; and a flexible web connecting said second lobe to said first and third lobes.

8. A pillow, comprising:

an under-knee pillow portion, defining a width, length, and height;

a between-knee pillow portion, defining a top, bottom, and left and right sides; and a flexible web connecting said between-knee portion to said under-knee portion; said flexible web defining a length, extending from the under-knee pillow portion to the between-knee pillow portion, and defining a thickness, substantially perpendicular to the length, wherein the length of said web is substantially greater than the thickness of said web, and further comprising a second between-knee pillow; and a second web connecting said second between-knee pillow to said under-knee pillows, wherein the second web also defines a length and a thickness, with the length of said second web, extending between the under-knee pillow portion and the second between-knee pillow portion, being substantially greater than its thickness, so that a user can lie on his back, with the between-knee portion between his knees and the under-knee portion resting behind him, with the flexible web permitting automatic adjustment of the relative positions of the pillow portions to accommodate different sizes of users.

9. A pillow, comprising:

an under-knee pillow portion, defining a width, length, and height;

a between-knee pillow portion, defining a top, bottom, and left and right sides; and a flexible web connecting said between-knee portion to said under-knee portion, wherein said under-knee portion is longer in the direction substantially perpendicular to said web than in the direction of said web, and said between-knee portion is longer in the direction of said web than in the direction substantially perpendicular to said web, so that a user can lie on his back, with the under-knee portion under his knees, and can roll to his side, with the between-knee portion between his knees and the under-knee portion resting behind him, with the flexible web permitting automatic adjustment of the relative positions of the pillow portions to accommodate different sizes of users.

* * * * *